US011795715B2

(12) United States Patent
Meyer

(10) Patent No.: US 11,795,715 B2
(45) Date of Patent: Oct. 24, 2023

(54) CUSTOMIZED AND ASSEMBLED POOL

(71) Applicant: Latham Pool Products, Inc., Latham, NY (US)

(72) Inventor: Christopher Meyer, Baulkham Hills (AU)

(73) Assignee: Latham Pool Products, Inc., Latham, NY (US)

( * ) Notice: Subject to any disclaimer, the term of this patent is extended or adjusted under 35 U.S.C. 154(b) by 115 days.

(21) Appl. No.: 16/925,316

(22) Filed: Jul. 9, 2020

(65) Prior Publication Data

US 2021/0131131 A1 May 6, 2021

Related U.S. Application Data

(60) Provisional application No. 62/929,534, filed on Nov. 1, 2019.

(51) Int. Cl.
*E04H 4/00* (2006.01)
*E04H 4/12* (2006.01)

(52) U.S. Cl.
CPC ..... *E04H 4/0037* (2013.01); *E04H 4/12* (2013.01)

(58) Field of Classification Search
CPC ..... E04H 4/0037; E04H 2004/0068; E04H 4/0018
USPC ..... 4/509
See application file for complete search history.

(56) References Cited

U.S. PATENT DOCUMENTS 7,712,161 B2 * 5/2010 Reynolds, II ..... A61H 33/02 601/166
D882,822 S 4/2020 Painter et al.
2006/0288476 A1 * 12/2006 Reynolds, II ..... A61H 33/00 4/541.1
2015/0337551 A1 * 11/2015 Romano ..... B29C 39/003 52/741.12

(Continued)

FOREIGN PATENT DOCUMENTS

AU 201813662 7/2018
AU 2018282264 7/2019

(Continued)

OTHER PUBLICATIONS

Premier Box, "Shipping Container Swimming Pools", https://premiershippingcontainers.com.au/2017/11/01/shipping-container-swimming-pools/, , Nov. 1, 2017, pp. 1-16.

(Continued)

*Primary Examiner* — Christine J Skubinna
(74) *Attorney, Agent, or Firm* — Kilpatrick Townsend & Stockton LLP

(57) ABSTRACT

Described herein is a pool assembly and methods of manufacturing and/or installing the pool assembly thereby providing for an above ground pool that may be personally customized by a user. The pool assembly may include a pool shell, a support structure, including a base member and support members, and a filtration system. A user may customize, or design, the pool assembly, including shape, size, and dimensions, such that the pool assembly may be delivered in a plumbed and ready to fill state. Upon delivery, the pool need only be positioned on a flat, or level, surface, coupled to an energy source and filled with water, thereby eliminating the need for additional assembly or skilled labor.

20 Claims, 18 Drawing Sheets

(56) References Cited

U.S. PATENT DOCUMENTS

| | | | | |
|---|---|---|---|---|
| 2016/0151695 | A1* | 6/2016 | Pacheco Moreira Amorim | E04H 4/0018 73/826 |
| 2016/0298348 | A1* | 10/2016 | Lisk | E04H 4/0018 |
| 2018/0119440 | A1* | 5/2018 | Sanchez | E04H 4/0031 |
| 2018/0148945 | A1* | 5/2018 | Roux | E04H 4/0018 |
| 2018/0299115 | A1* | 10/2018 | Coelho | F21V 15/01 |
| 2022/0119149 | A1 | 4/2022 | Comerford | |

FOREIGN PATENT DOCUMENTS

| | | |
|---|---|---|
| AU | 202014372 | 10/2020 |
| AU | 2021103406 | 6/2021 |
| NZ | 738725 | 12/2017 |
| NZ | 423883 | 1/2019 |
| NZ | 424082 | 1/2019 |
| NZ | 751820 | 6/2019 |
| NZ | 427133 | 12/2020 |

OTHER PUBLICATIONS

Youtube, "Shipping Container Pool—Modpools", https://www.youtube.com/watch?v=Yy97cU_hpuc&t=8s, Apr. 7, 2017, pp. 1-7.
Youtube, "shipping Container Pools Summer", https://www.youtube.com/watch?v=1_H8AMwd1Dg, Dec. 1, 2016, pp. 1-6.
Modpools, https://modpools.com/, 2021, 1-9 pages.
Youtube, "Shipping Container Pools", Shipping Container Pools—YouTube, Dec. 4, 2016, pp. 1-13.

* cited by examiner

| | Dimensions | | | | | |
|---|---|---|---|---|---|---|
| | Internal | | | External | | |
| Pool Design | Length | Width | Depth | Length | Width | Height |
| Pool design A | 5.0m | 2.3m | 1.45m | 5.7m | 2.7m | 1.55m |
| Pool design B | 8.0m | 2.3m | 1.45m | 8.7m | 2.7m | 1.55m |
| Pool design C | 11.0m | 2.3m | 1.45m | 11.7m | 2.7m | 1.55m |
| Pool design D | 5.0m | 2.7m | 1.45m | 5.7m | 3.1m | 1.55m |
| Pool design E | 6.0m | 2.7m | 1.45m | 6.7m | 3.1m | 1.55m |
| Pool design F | 7.0m | 2.7m | 1.45m | 7.7m | 3.1m | 1.55m |

FIG. 11

CUSTOMIZED AND ASSEMBLED POOL

REFERENCE TO RELATED APPLICATIONS

This application claims the benefit of U.S. Provisional Application No. 62/929,534, filed Nov. 1, 2019, entitled "Customized and Assembled Pool," the entire contents of which are incorporated herein by reference.

FIELD OF THE INVENTION

This application relates generally to above ground pool assemblies, and more particularly, although not necessarily exclusively, to an above ground pool assembly that is customizable and already plumbed and ready to be filled with water upon delivery.

BACKGROUND

Fiberglass inground pools and concrete inground pools can be expensive and time consuming to install. Installation to these pools can also require skilled labor. For example, equipment and tradesman can be required to prepare a hole, install plumbing features, and install surrounding decking. For example, fiberglass inground pools can cost approximately $30,000-$80,000 while concrete inground pools can cost well over $80,000. Historically, above ground pools, including inflatable pools, while inexpensive (approximately less than $15,000) can be an eyesore. For example, above ground pools historically comprise vinyl or plastic siding or visible support beams and plastic wall pieces. and can be limited in the location in in which they may be installed due to requirements for the surface on which the above ground pool is installed.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

FIG. 11 is a table depicting exemplary sizes of a pool assembly according to aspects of the present disclosure.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
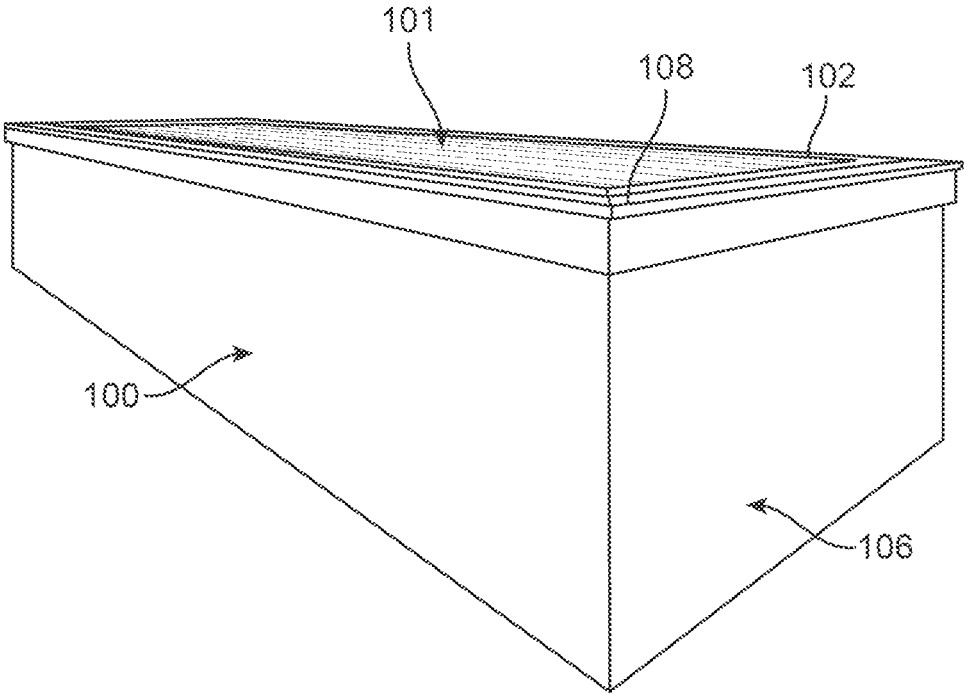
FIG. 1 is a perspective view of a pool assembly according to embodiments of the present disclosure.

Certain embodiments and features of the present disclosure relate to a pool assembly and method of manufacturing of the pool assembly that provides for an above ground pool that may be personally customized (or designed) by a user, for example on-line or in person at a dealer location, and which may be delivered in a plumbed and ready to fill state. In some embodiments, a user may select a pool shape and size, for example from a select number of shape and size options. The user may also select a shell color for the pool, a cladding for the pool, a coping, and optional features for the pool assembly. Additional features and equipment may also be selected by a user, for example stairs, a deck region, or other features and equipment. According to embodiments of the present disclosure, the pool assembly can include a support structure that includes a base member coupled to a floor or bottom region of the pool shell. The support structure can also include multiple support members extending between the base member and the side region of the pool shell to provide a stable and a structurally sound pool assembly. The base member may also include a flat surface that permits the pool to be installed upon delivery on any flat (or level) surface. Upon delivery the pool may only need be positioned on the flat surface, coupled to an energy source (e.g. plugged in to a power outlet), and filled with water. Thus, in embodiments of the present disclosure the pool assembly may be assembled prior to delivery such that no additional assembly may be required upon delivery providing for ease of installation and correspondingly low installation time and costs According to embodiments of the present disclosure, as shown in FIG. 1, a pool assembly 100 may include a pool shell 102, a support structure 104 (shown for example in FIGS. 5-6), which may include a base member 105 coupled to a floor or bottom region 102*a* (shown for example in FIG. 5) of the pool shell 102. The support structure 104 may further include one or more support members 110 extending between the base member 105 and a side region 102*b* of the pool shell 102 to provide a stable and a structurally sound pool assembly 100 (shown for example in FIG. 5). The one or more support member 110 and/or the base member 105 may include a flat surface that permits the pool assembly 100 to be installed upon delivery on a receiving surface 10. Upon delivery, the pool assembly 100 may only need be positioned on the receiving surface 10, coupled to an energy source (e.g., plugged into a power outlet), and filled with water. Thus, in embodiments of the present disclosure, the pool assembly 100 may be assembled prior to delivery such that no additional assembly may be required upon delivery and, thereby, providing for ease of installation and correspondingly low installation time and costs. The pool assemblies shown in FIG. 1 and FIG. 2 may include the same or similar features, and are identified as pool assembly 100 herein.

According to some embodiments, as illustrated in FIGS. 1-6, a pool assembly 100 may include the pool shell 102 defining an interior space 101 and the support structure 104 forming a base of the pool assembly 100. The pool assembly 100 may further include a cladding 106 and a coping 108 arranged around a perimeter of the pool shell 102 and forming an outer surface of the pool assembly 100.

Figure 2:
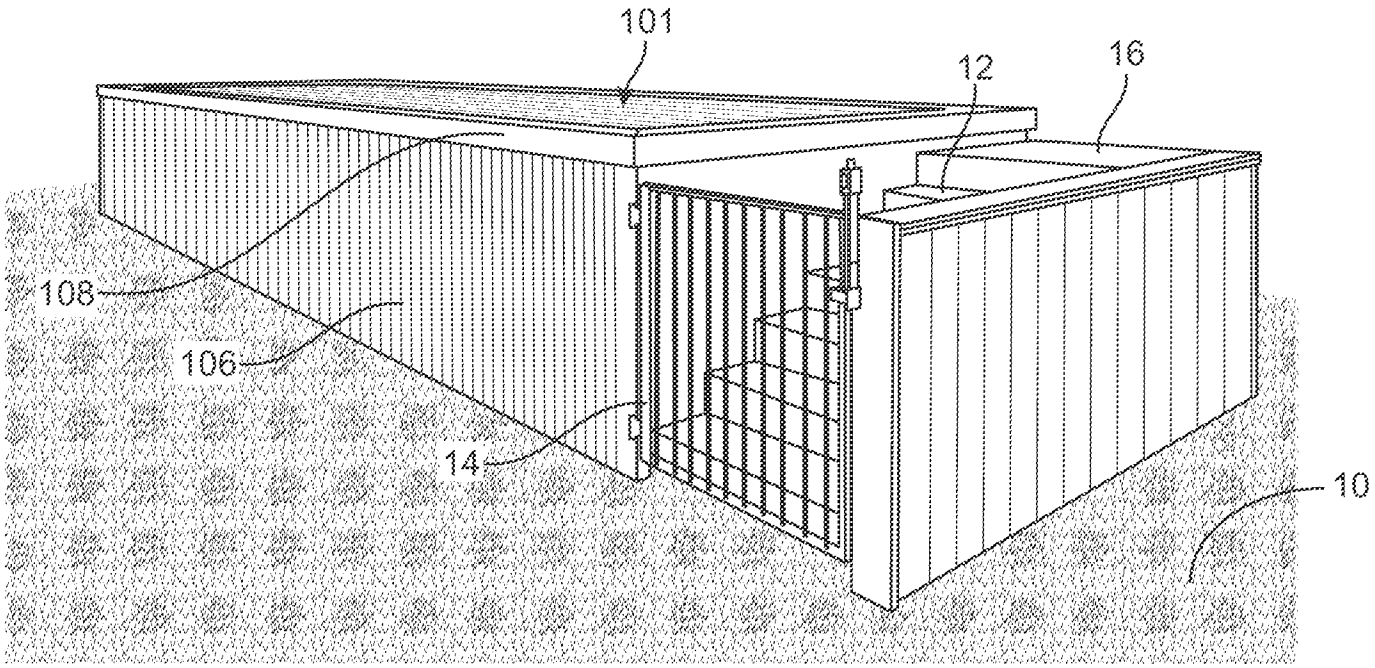
FIG. 2 is a perspective view of the pool assembly including additional features, according to embodiments of the present disclosure.
Figure 3:
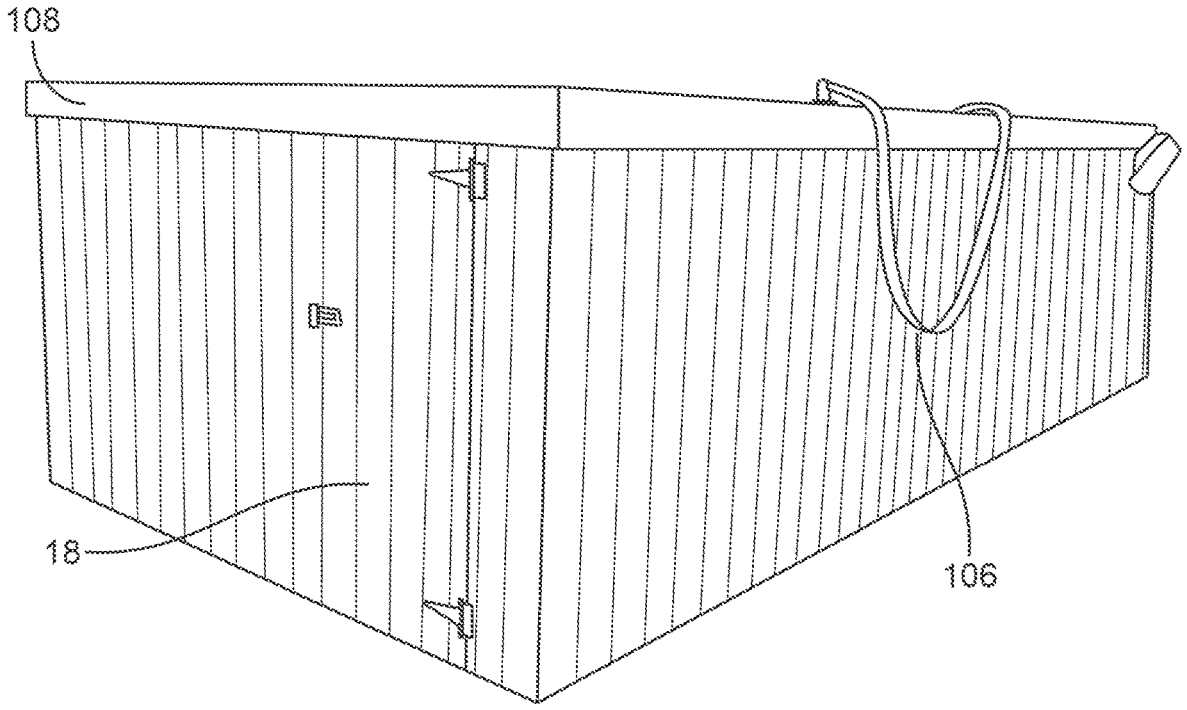
FIG. 3 is a perspective view of the pool assembly of FIG. 2 according to embodiments of the present disclosure illustrating a door in the cladding.

In some embodiments, as illustrated in FIGS. 1-3, the pool shell 102 may be comprise a rectangular shape. However, the pool shell 102 may be any suitable shape, including, but not limited to, square, triangle, circle, oval, freeform, or any other suitable shape.

Figure 5:
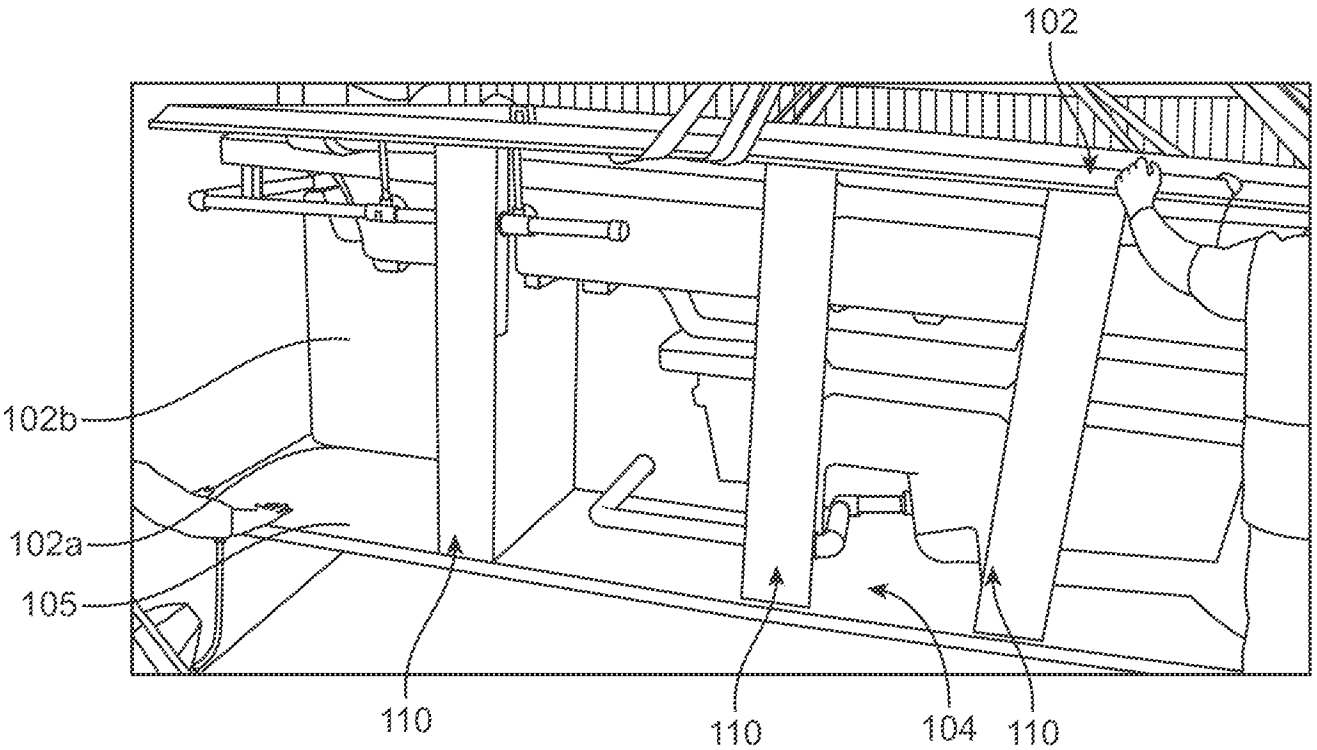
FIG. 5 is a side view of a pool assembly with the cladding removed.
Figure 6:
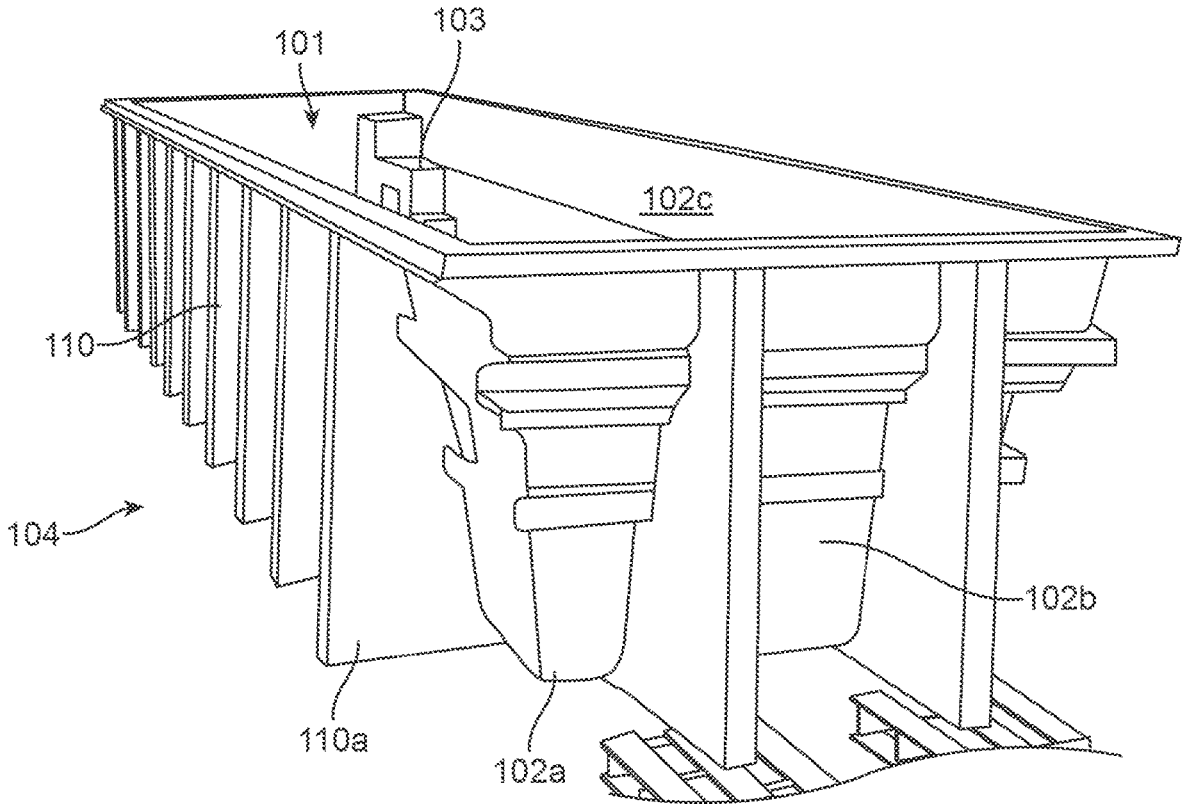
FIG. 6 is perspective view of another embodiment of the pool assembly with the cladding removed.

In some embodiments, the pool shell 102 may have a length that ranges in size between approximately 5 meters and 12 meters (e.g., between 5 meter and 11 meters, between 5 meters and 7 meters, between 7 meters and 11 meters). In some aspects, the length of the pool shell 102 at the waterline may be between approximately 5 meters and 11 meters. In some aspects, the overall length of the pool shell 102 may be between approximately 5.3 meters and 12 meters. Moreover, the pool shell 102 may have a width that ranges in size between approximately 2 meters and 7 meters (e.g. between 2 meters and 6 meters, between 2 meters and 5 meters, between 2 meters and 3 meters). In some aspects, the pool shell 102 may have a width of approximately 2.3 meters at the water line. In some aspects, the pool shell 102 may have a width of approximately 2.5 meters at a top edge of the pool shell. In particular, the pool shell 102 may have a length that is greater than 8 meters and a width that is greater than 2.3 meters. The pool shell 102 may have a depth of between approximately 1 meter to 2 meters. In some aspects, the pool shell 102 may have a depth of approximately 1.45 meters. In some embodiments, the pool shell 102 of the pool assembly 100 may be between approximately 29 square meters to approximately 60 square meters in surface area (e.g. between approximately 29 square meters and 35 square meters, between approximately 30 square meters and 45 square meters, between approximately 40 square meters and 60 square meters). In some embodiments, the pool shell 102 of the pool assembly 100 may be sized, shaped, and sufficiently supported to receive between approximately 16,000 gallons and 36,000 gallons of water (e.g. between 16,000 gallons and 20,000 gallons, between 18,000 gallons and 25,000 gallons, between 22,000 gallons and 36,000 gallons). FIG. 5 depicts exemplary non-limiting measurements of pool shells, for example pool shell 102, In other embodiments, the pool shell 102 may be formed as having a circular shape and may have a diameter that ranges between 2 meters and 5 meters. In some embodiments, the pool shell 102 may be sized and shaped such that the pool assembly 100 may be shipped as a non-oversized load, thus reducing the shipping costs. However, the pool shell 102 may be any suitable size and may not be limited to the dimensions of a shipping container. Should the user desire that the pool shell meet oversized load transportation size requirements, the pool shell 102 may have a length up to 12 meters and a width up to 4.5 meters. Though the pool assembly 100 depicted as in FIGS. 1-2 and 6 illustrates one pool assembly 100, more than one pool assembly may be joined together thereby forming a larger pool onsite.

Figure 4:
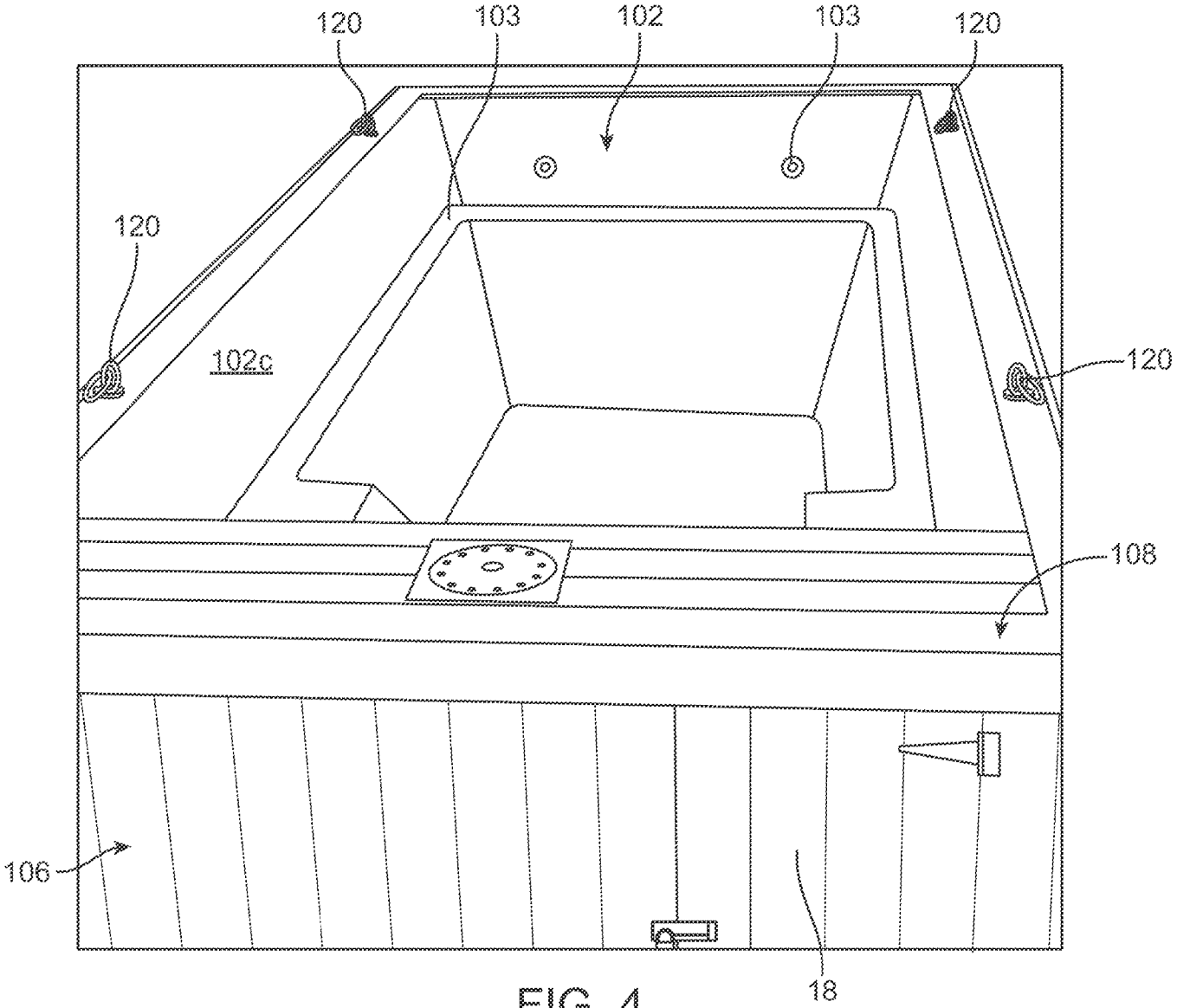
FIG. 4 is a top perspective view of the pool assembly of FIG. 2.

As illustrated in FIG. 4, the pool shell 102 may include an exterior surface 102*c* arranged to form the outer bounds of the interior space 101. In one non-limiting embodiment, the exterior surface 102*c* may be formed by a gel coat layer used during manufacture of the pool shell 102, which will be described in greater detail. The exterior layer 102*c* may comprise a color (e.g., blue) based on a user's selection, and, which thereby determines the color of the pool shell 102. As illustrated in FIG. 3, the pool shell 102 may further include additional features 103. For example the additional features 103 may include, but not limited to, seats, steps, ledges, benches, jets and/or any other suitable features.

The pool shell 102 may be formed of a fiberglass material, a composite material, or any other suitable material. Fiberglass as used herein includes variations of thermosetting polymers, for example, reinforcing and thermosetting polymer composites. As such, materials in the reinforcement may include a fiberglass, a filler, aramid, carbon fiber, Sepctra, or any combination thereof.

FIGS. 1-4 illustrate pool assemblies having the same and different cladding 106, which may form an outer perimeter of the pool assembly 100. The cladding 106 may be coupled to frame members, for example support member 110 (illustrated in FIG. 5), which are coupled to the pool shell 102. In some embodiments, the cladding 106 of the pool assembly 100 may comprise a composite material that is non-metallic and has weather resistant properties. Because the cladding 106 comprises a non-metallic material, for example a composite material, the cladding 106 may not require electrical grounding, or earthing, and will not rust or corrode. For example, the cladding 106 may comprise a core comprising approximately 60% recycled dense wood fiber mixed with 40% high grade recycled plastics, and a shield layer. The shield layer may comprise a special engineering grade polymer and additives that provide the cladding 106 with extremely low water penetration, for example, but not limited to, composite materials offered by Newtechwood. In some embodiments, the cladding 106 may comprise a composite material that includes a fiber reinforced cement product, for example, but not limited to, materials comprising cellulose fiber, Portland cement, sand, and water (including, for example James Hardies Linea™ Board), or other suitable fiber reinforced cement products. In some embodiments, the cladding 106 may comprise fiberglass materials. In other embodiments, the cladding 106 may comprise a metallic or other non-composite material. The particular cladding 106 may be determined by a user may when designing, or customizing, the pool assembly 100.

In some embodiments, as illustrated in FIGS. 1-4, the pool assembly 100 may include the coping 108, which forms an upper surface of the pool assembly 100. The coping 108 may cover an upper end of the pool shell 102 and thus prevent water from getting behind the pool shell 102 (i.e., the space between the pool shell 102 and the cladding 106). Moreover, the cladding 106 may extend between the coping 108 and the support structure 104 of the pool assembly 100 such that the cladding 106 is positioned exteriorly to the pool shell 102 for covering the outer surface of the pool shell 102 from view and may thereby provide a visually appealing look to the pool assembly 100. The cladding 106 may be selected by a user to match or coordinate with the style of the user's home or installation site and may be selected from a variety of materials, colors, patterns, textures, and other characteristics.

The coping 108 may be selected from multiple coping options, for example, but not limited to, wood, non-metallic materials, metallic materials, stone, brick, composite, vinyl, or any other suitable materials. In some non-limiting embodiments, the coping 108 may be formed of the same materials as the cladding 106 such that the coping 108 and the cladding 106 match. In other embodiments, however, the cladding 108 and the coping 106 may be formed of different materials.

FIGS. 5-6 illustrate examples of the support structure 104 of the pool assembly. In some embodiments, the support structure 104 includes at least one base member 105 that may be coupled directly or indirectly to the floor and/or bottom region 102*a* of the pool shell 102. The base member 105 may also be coupled to one or more sides 102*b* of the pool shell 102 via support members 110 to provide additional structural support to the pool shell 102. In particular, the base member 105 may provide structural strength to the pool shell 102 and prevent the side walls 102*b* of the pool shell 102 from deflecting due to pressure of the water when the interior space 101 of the pool assembly 100 is filled with water. The support members 110 may extend vertically from the base member 105 and may extend horizontally from the side wall 102*b* of the pool shell 102. Though only one base 105 is illustrated in FIG. 5, the pool assembly 100 may include multiple bases 105 coupled to the pool shell 102.

In some embodiments, as illustrated in FIG. 5, the support structure 104 may provide a flat surface, for example via an underside of the base member 105, that thereby improves placement of the pool assembly 100 on the receiving surface 10 (shown in FIG. 2) onto which the pool assembly is to be installed. For example, the base member 105 may be a flat member and extend beyond the bottom surface 102*a* of the pool shell 102 such that the base member 105 has a bigger foot print than the bottom 102*a* of the pool shell 102. The base member 105 may provide a flat surface for installation of the pool assembly 100 thereby not requiring skilled labor to prepare a site for installation of the pool assembly 100. In some aspects, no base member 105 may be included in the pool assembly 100 and the support members 100 may provide a flat surface for installation of the pool assembly 100. Moreover, the pool assembly 100 may be installed on any flat, or level, receiving surface 10 and, for example, may allow for a do-it-yourself process that does not require skilled labor. In some embodiments, the base member 105 may be capable of supporting a compressive pressure that ranges from 0.8-2.4 megapascal (MPA) per square meter. In particular, the base member 105 may be capable of supporting a compressive pressure of 1.6 MPA per square meter. Furthermore, in some embodiments, the base member 105 may allow for installation of the pool assembly 100 on flat and level surfaces that are compacted to at least 90 KPA bearing pressure (e.g., 90 KPA, 95 KPA, 100 KPA, 105 KPA). In other embodiments, the base member 105 may allow for installation of the pool assembly 100 on flat and level surfaces that are compacted to less than 90 KPA.

Furthermore, as the support structure 104 allows for easier installation of the pool assembly 100 by allowing for installation on essentially any flat, or level, receiving surface 10, the need for a reinforced concrete slab (e.g. a 110 mm thick reinforced concrete slab) or other custom built concrete receiving surface may be eliminated. In some examples, the pool assembly 100 may be installed on a variety of surfaces, including, but not limited to, concrete, crusher dust or road base (e.g., compressed surfaces that are approximately 50 mm thick or greater), or any other suitable surface. In other examples, the pool assembly 100 may be installed on, for example, a pre-existing driveway or other concrete surface that has not been specially poured to support the pool assembly 100. In still yet other examples, the pool assembly 100 may be installed on a level non-compactable base. Therefore, the support structure 104 may eliminate the need for installation of additional support features when installing the pool assembly 100. For example, unlike traditional pool assemblies, which require installation of additional support beams or support features during the installation process, the installation of the pool assembly 100 may not require on site installation of additional support beams or features.

In some embodiments, as illustrated in FIG. 6, the pool assembly 100 may not include the base member 105. Rather, the support members 110 of the support structure 104 may extend outwardly from the side region of the pool shell 102. The support members 110 may include a substantially flat bottom surface 110*a*. For example, the support members 110 may include additional support surfaces provided on, or extending from, a bottom region of the support member 110. The substantially flat bottom surface 110*a* of the support member 110 may or may not extend such that edges of the substantially flat support surfaces contact one another. The substantially flat support surface 110*a* may provide support to the pool shell 102, while also providing a flat surface for aiding in installation of the pool assembly 100 on the receiving surface 10.

As described above, in some embodiments, the entire pool assembly 100, including the pool shell 102, the support structure 104, the coping 108, and the cladding 106, may all be formed of non-metallic materials. For example, the shell 102 may comprise a reinforcement material and thermosetting polymer composite. The reinforcement material may include, but is not limited to, fiberglass, filler, Aramid, carbon fiber, Spectra, or any combination thereof. Similarly, the support structure 104 may be formed of a composite material that does not rust or corrode and does not require electrical grounding. However, the support structure 104 is not limited to such materials. By using composite materials, the pool assembly 100 may eliminate the need for equipotential bonding or grounding. Thus, only the filtration system 200 may require grounding consistent with state, federal, and county regulations, for example standard wiring connections fitted to the filtration system 200 and a power source. Moreover, unlike traditional pools and/or hot tubs, the materials used to form the pool assembly 100 allow for more additional flexibility while not sacrificing strength. As such, should the receiving surface 10 include certain deformities or imperfections that render the receiving surface 10 (shown in FIG. 2) not completely level, the pool assembly 100 may still be installed without fear of cracking or breaking.

In some embodiments, as illustrated in FIG. 2, the pool assembly 100 may include additional features such as stairs 12 and a gate 14 that restricts access to the stairs 12. The gate 14 may be designed such that it satisfies laws and/or regulations regarding fencing/gating for restricting access to the pool assembly 100. The pool assembly 100 may further include a deck feature 16. In some embodiments, the stairs 12, gate 14, and/or deck feature 16 may be installed when the pool assembly 100 arrives at the end user's location. In other embodiments, pool assembly 100 may be fully assembled with the stairs 12, gate 14, and/or deck feature 16 prior to delivery. In still yet other embodiments, the pool assembly may not include a deck feature 16, stairs 12, and/or gate 14. The pool assembly 100 may be positioned such that it is adjacent to, surrounded by, or otherwise accessible via a pre-existing deck.

In some embodiments, the pool assembly 100 may further include additional features, including, but not limited to chlorinator systems (e.g., a salt chlorinator, a Magnapool chlorinator), a robotic cleaner, a pool light and transformer, extra or additional pool lights (e.g., white or colored LED lights), upgraded pumps (e.g., a heat pump, a variable speed pump upgrade), an automation system, a pool cover and roller, jets (e.g., swim jets or other jets), an airbed, a heating system, and any other suitable optional features.

Figure 7:
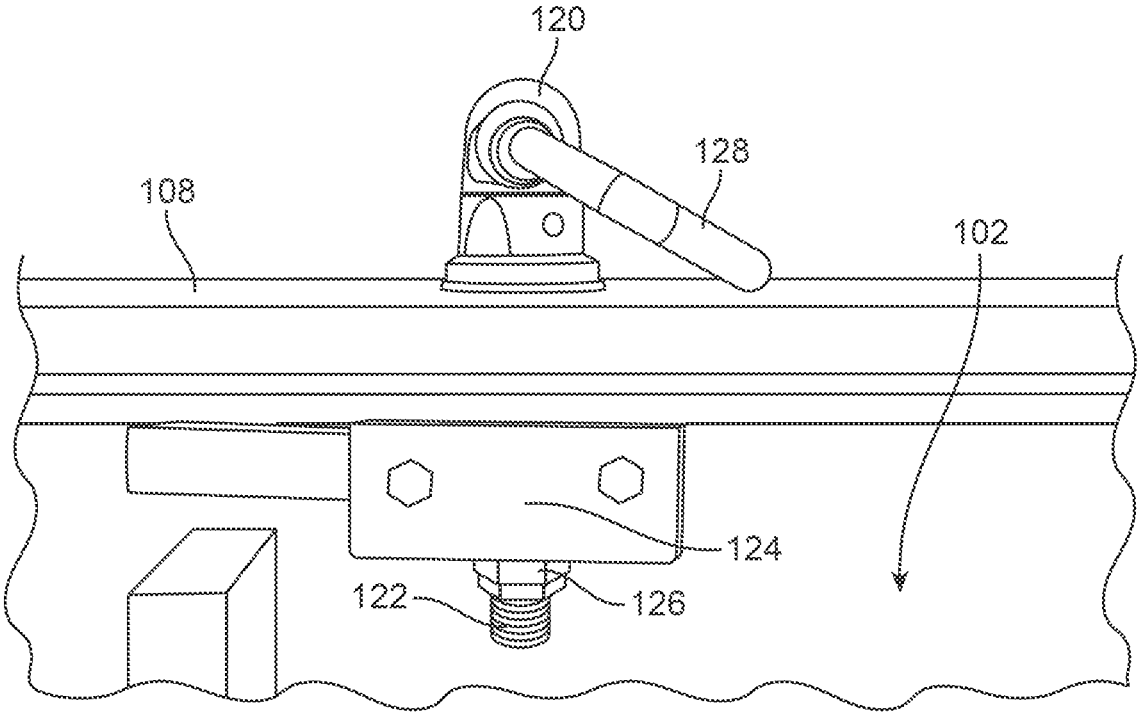
FIG. 7 is a side view of a lifting member of a pool assembly according to aspects of the present disclosure.
Figure 9A:
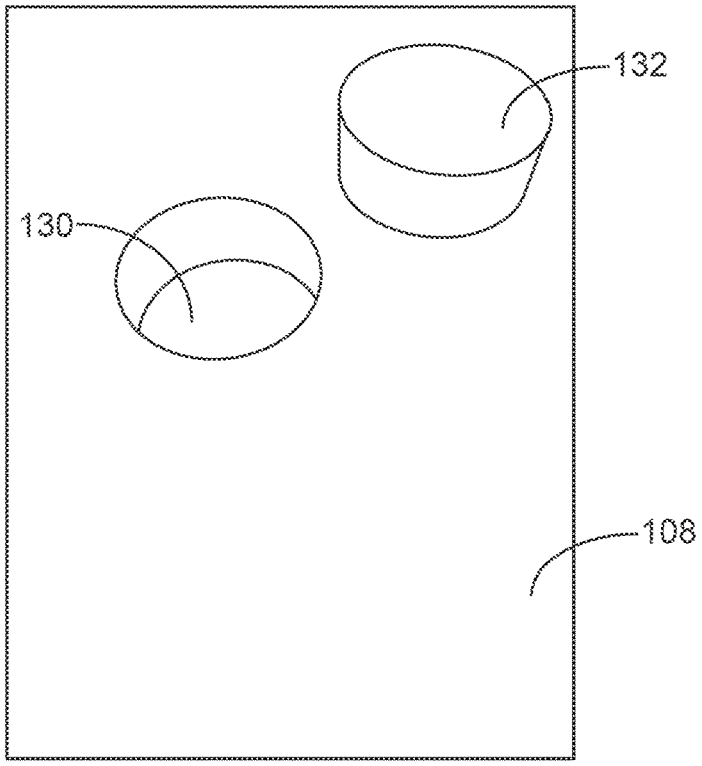
FIG. 9A is a perspective view of the cladding of the pool assembly of FIG. 1 with a plug member removed illustrating an opening in the cladding.
Figure 9B:
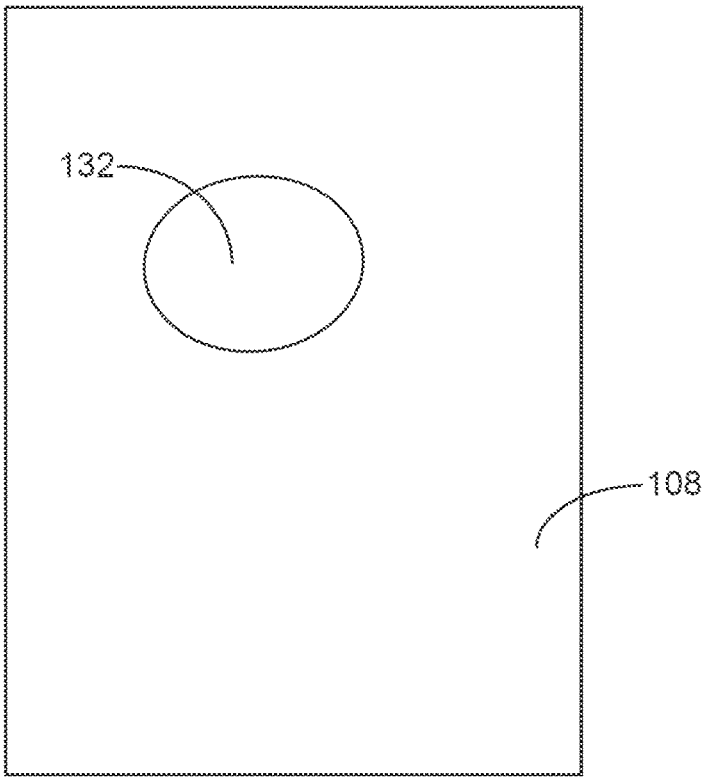
FIG. 9B is a perspective view of the cladding of the pool assembly of FIG. 1 with the plug member seated within the opening in the cladding.
Figure 10:
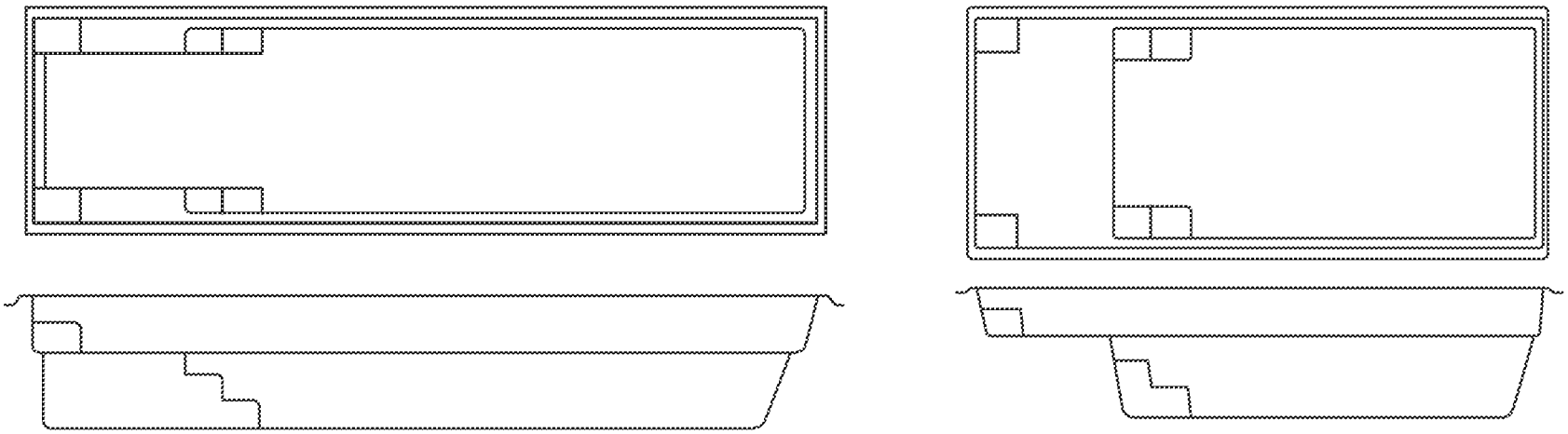
FIG. 10 depicts top and side views of a pool assembly according to aspects of the present disclosure.
Figure 12:
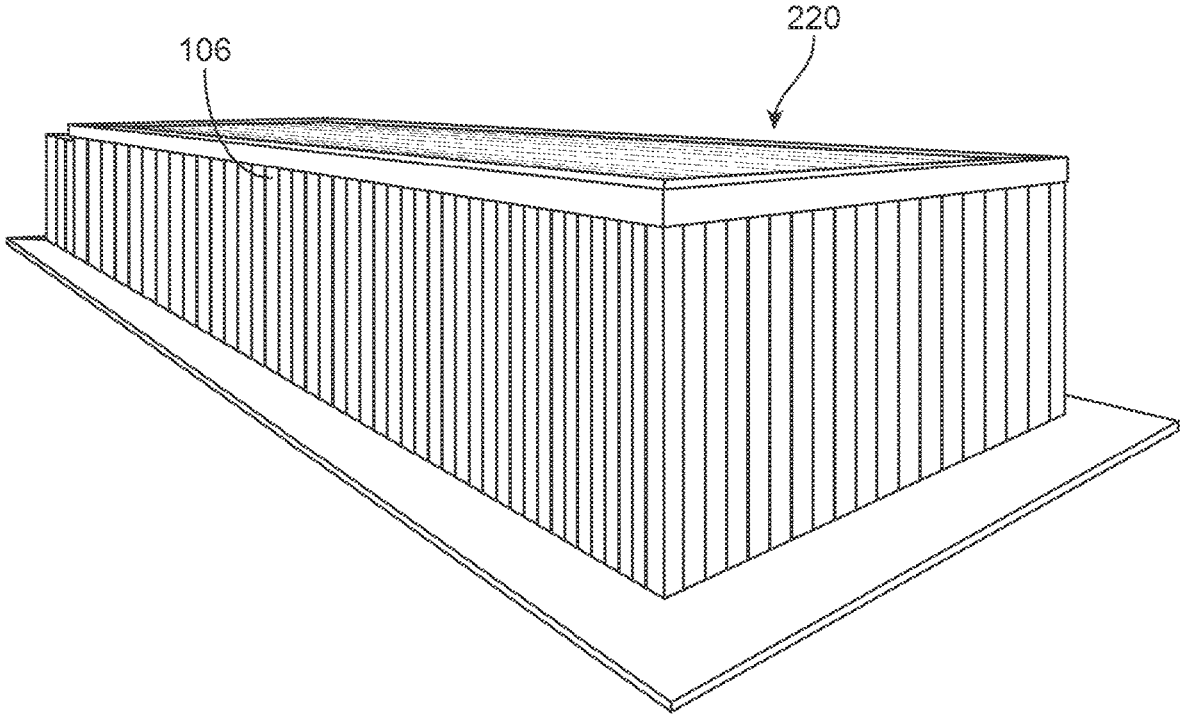
FIG. 12 is a perspective view of another embodiment of a pool assembly according to aspects of the present disclosure, including a cladding selection that has a wood-like appearance of a selected color.
Figure 13:
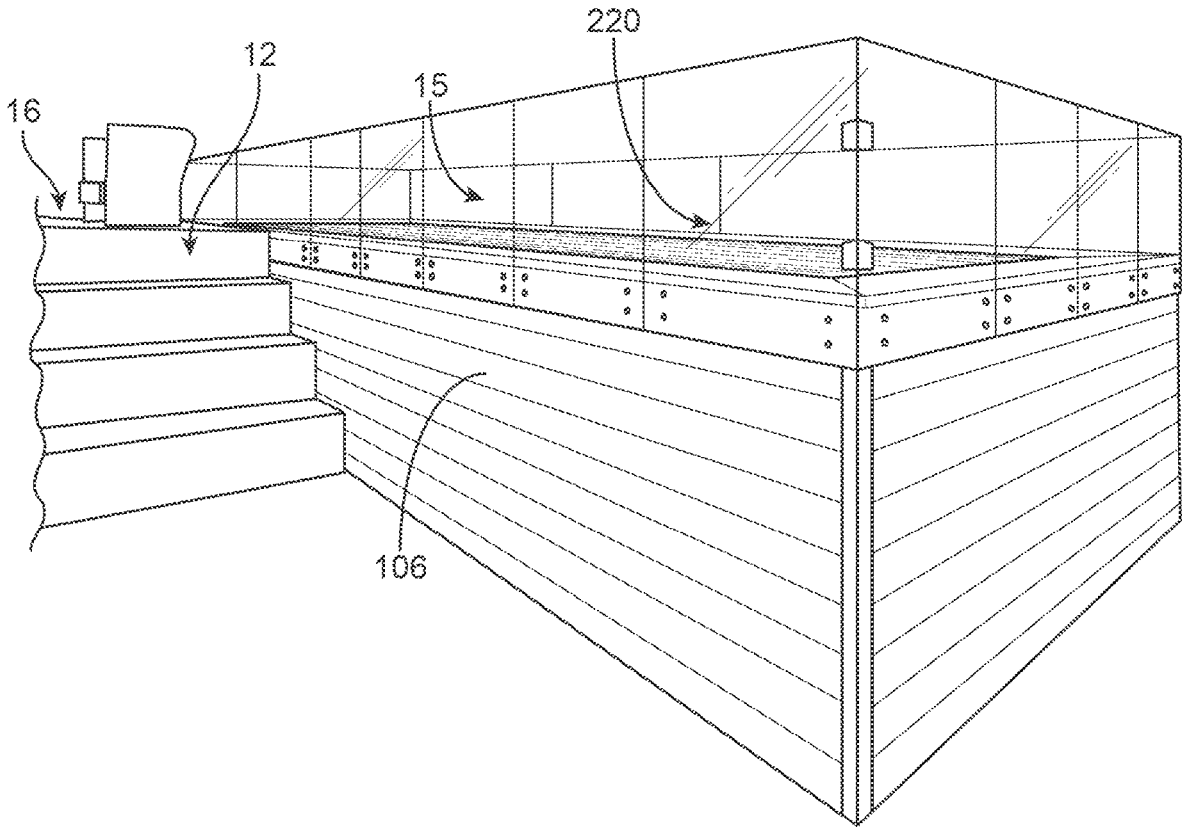
FIG. 13 is a perspective view of another embodiment of a pool assembly according to aspects of the present disclosure, including a cladding selection that differs from the cladding selection in the pool assembly of FIG. 12, the pool assembly including additional features including a deck and fence enclosure.
Figure 14:
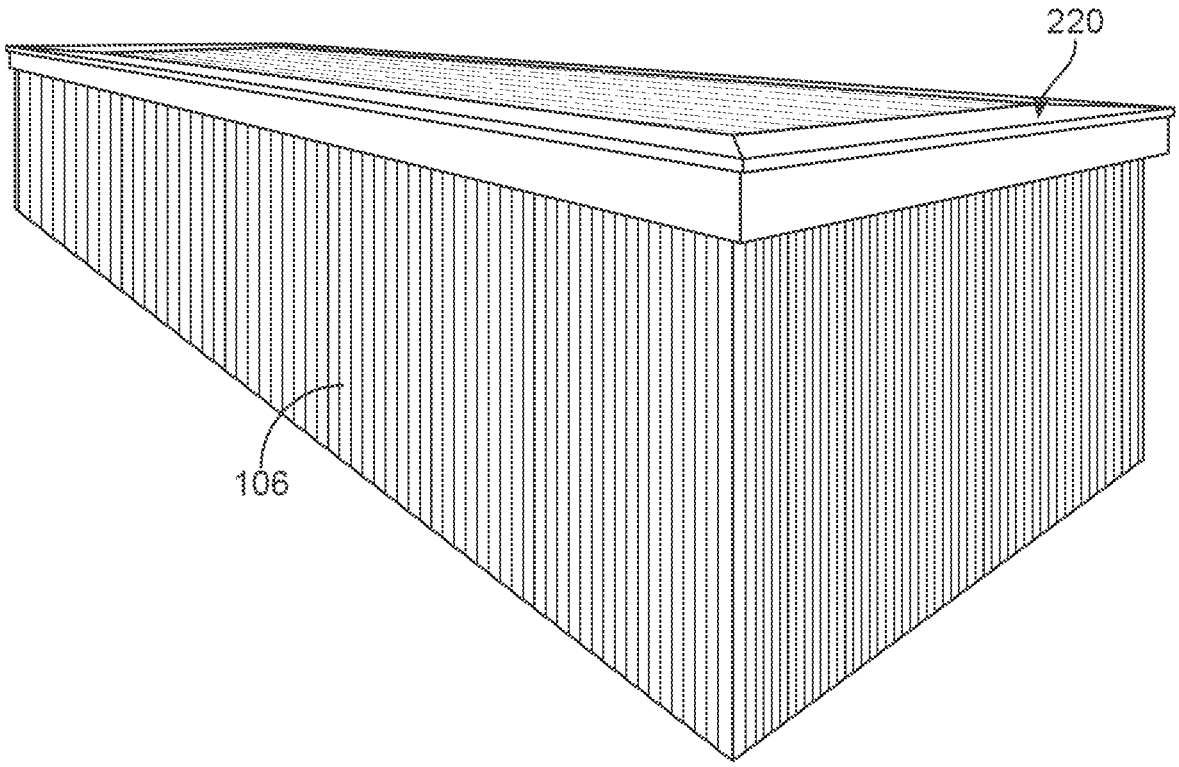
FIG. 14 is a perspective view of another embodiment of a pool assembly installed on a lawn surface, the pool assembly including a cladding selection that differs from the cladding selection of the pool assemblies of FIGS. 12 and 13.
Figure 15:
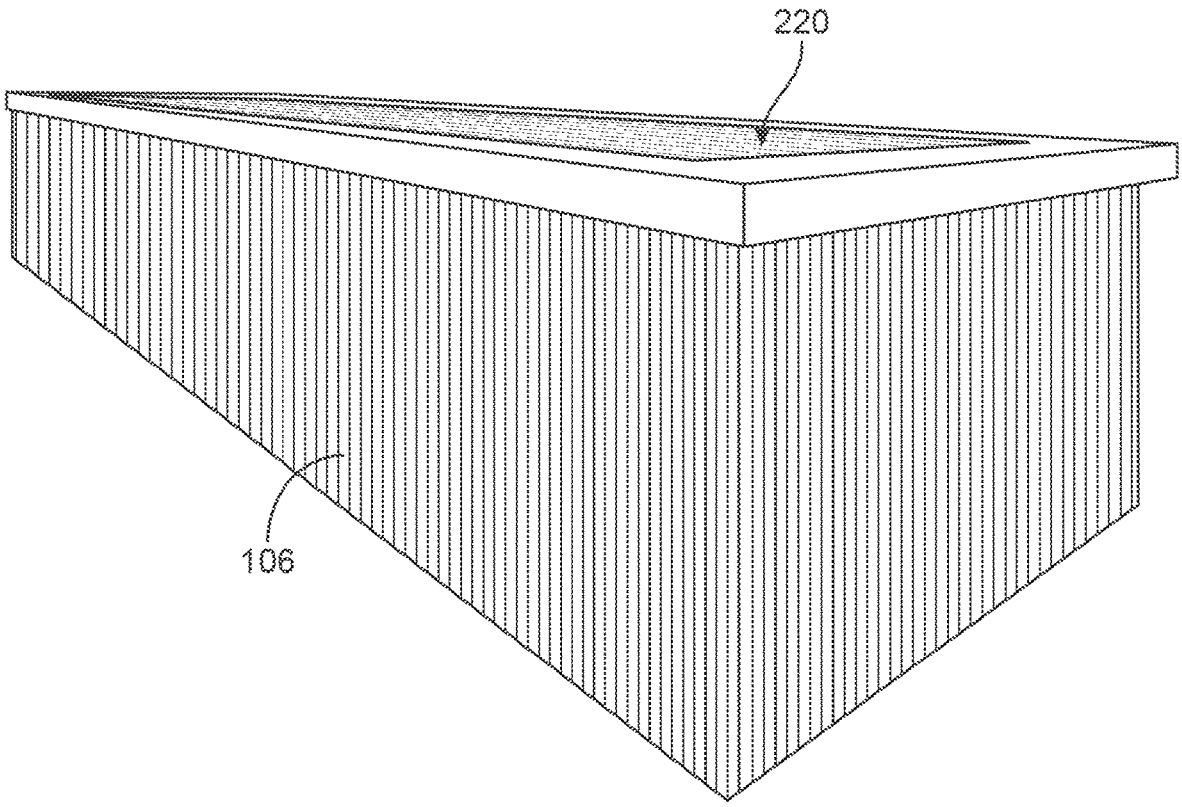
FIG. 15 is a perspective view of another embodiment of the pool assembly of FIG. 14 installed on a decking surface.

In some embodiments, as illustrated in FIGS. 4 and 7, the pool assembly 100 may include one or more lifting bolts 120 for coupling the pool assembly 100 to a crane or other equipment for moving the pool assembly 100 from a transport truck to the installation site. In some embodiments, as illustrated in FIG. 7, the lifting bolt 120 may include a lifting feature 128 that allows for the lifting bolt 120 to be coupled to a crane (or other equipment) via ropes or other lifting device. The lifting device may include, but is not limited to, chains, cable, wire, or any other suitable lifting device. The lifting feature 128 may be, for example, but not limited to, hook or loop, or any other suitable design to allow for lifting of the pool assembly 100. The lifting bolts 120 may be coupled to the coping 108 and the pool shell 102. Though four lifting bolts 120 are depicted in the pool assembly 100 shown in FIG. 4, more ore fewer lifting bolts 120 may be used. Similarly, though the lifting bolts 120 are shown as coupled to the coping 108 of the pool assembly 100, in other embodiments, the lifting bolts 120 may be coupled to another region or feature of the pool assembly 100. For example, the lifting bolts 120 may be coupled to the deck feature 16, stairs 12, etc. In some embodiments, the lifting bolts 120 may be coupled to the pool assembly 100 by positioning each lifting bolt 120 through an opening 130 (shown in FIG. 9A) in the pool assembly 100. For example, the coping 108 and/or the pool shell 102 may include the openings 130. As illustrated in FIG. 9B, the pool assembly 100 may include one or more plug devices 132 that may be received within the opening 130. Therefore, when the lifting bolt 120 is removed and the opening 130 is exposed, the plug 132 may be inserted within the opening 130 thereby covering the opening 130 and creating an aesthetically pleasing surface. The plug 132 may be formed of the same material as the coping 108, however it need not be and may be formed of a different material. Each lifting bolt 120 may be secured within the opening 130 by any suitable means, including for example, but not limited to, screwing. As illustrated in FIG. 7, the lifting bolt 120 may be coupled to a receiving feature 124 via a screw 122 and secured in place via a bolt 126. In other embodiments, the lifting bolt 120 may be removably coupled to the pool assembly 100 via other means, for example, but not limited to, adhesives, snap fit engagement, or any other suitable means.

Figure 8A:
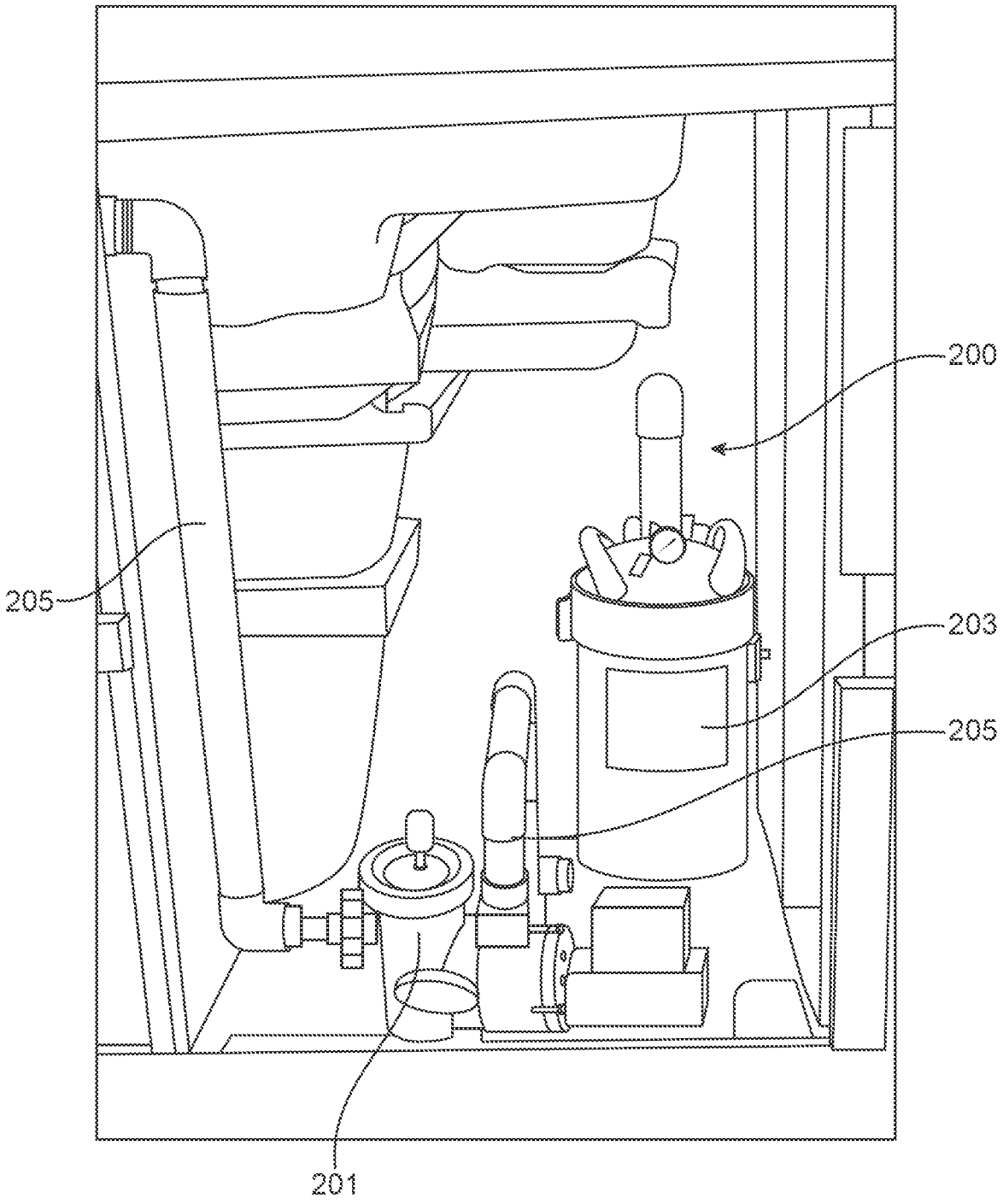
FIG. 8A depicts a filtration system of a completed pool assembly according to aspects of the present disclosure.
Figure 8B:
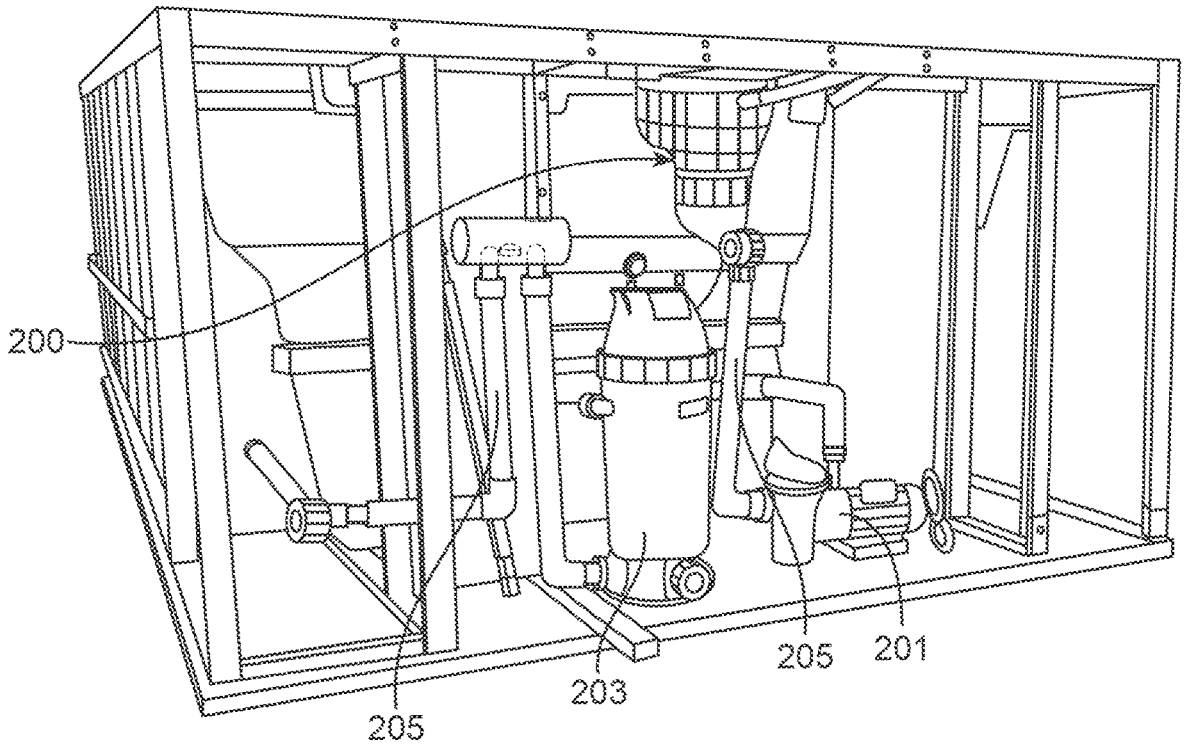
FIG. 8B depicts a filtration system installed in a pool assembly during manufacturing of the pool assembly according to aspects of the present disclosure.
Figure 8C:
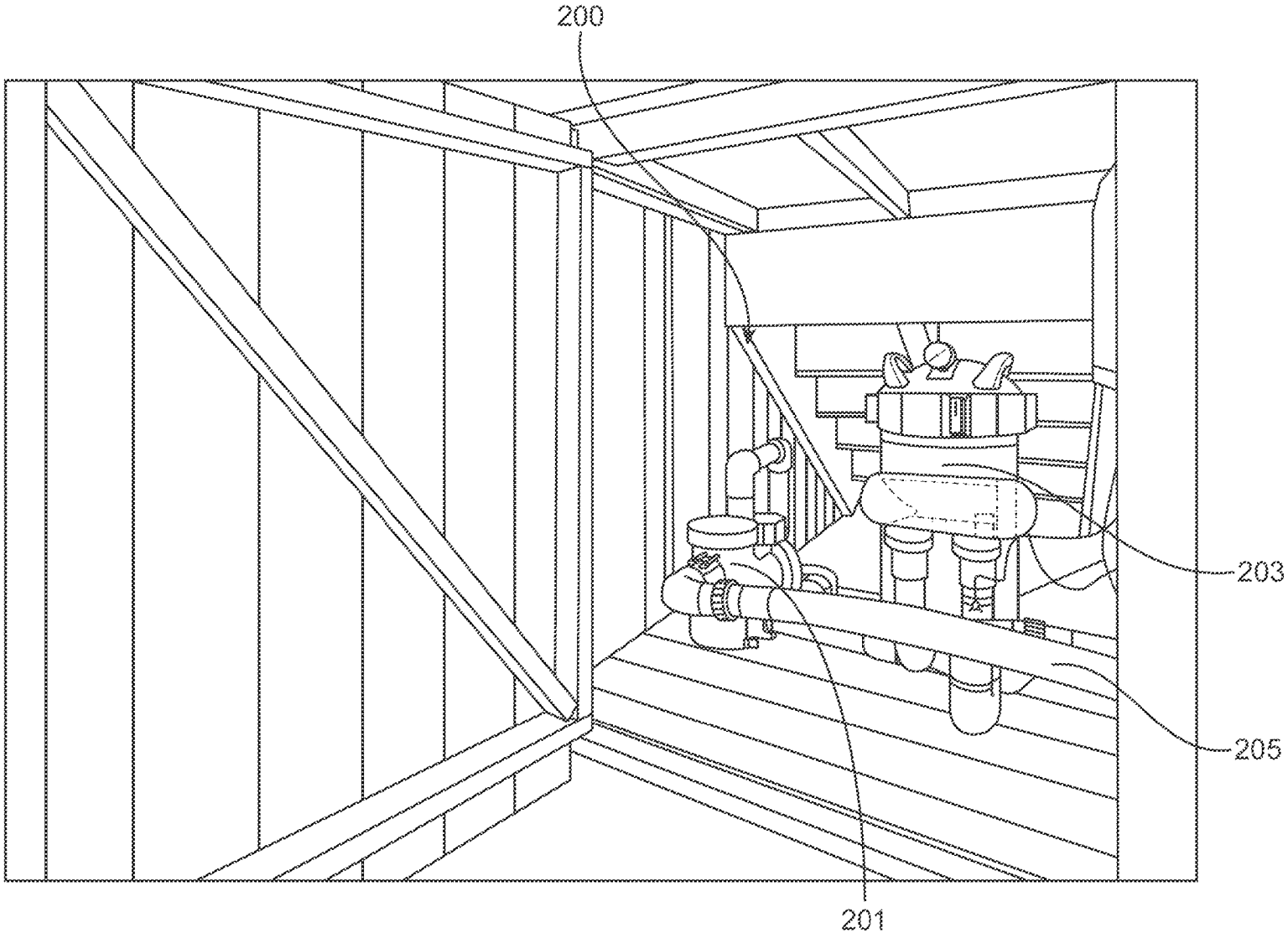
FIG. 8C depicts a filtration system accessible via a door in a cladding of a pool assembly according to aspects of the present disclosure.
Figure 8D:
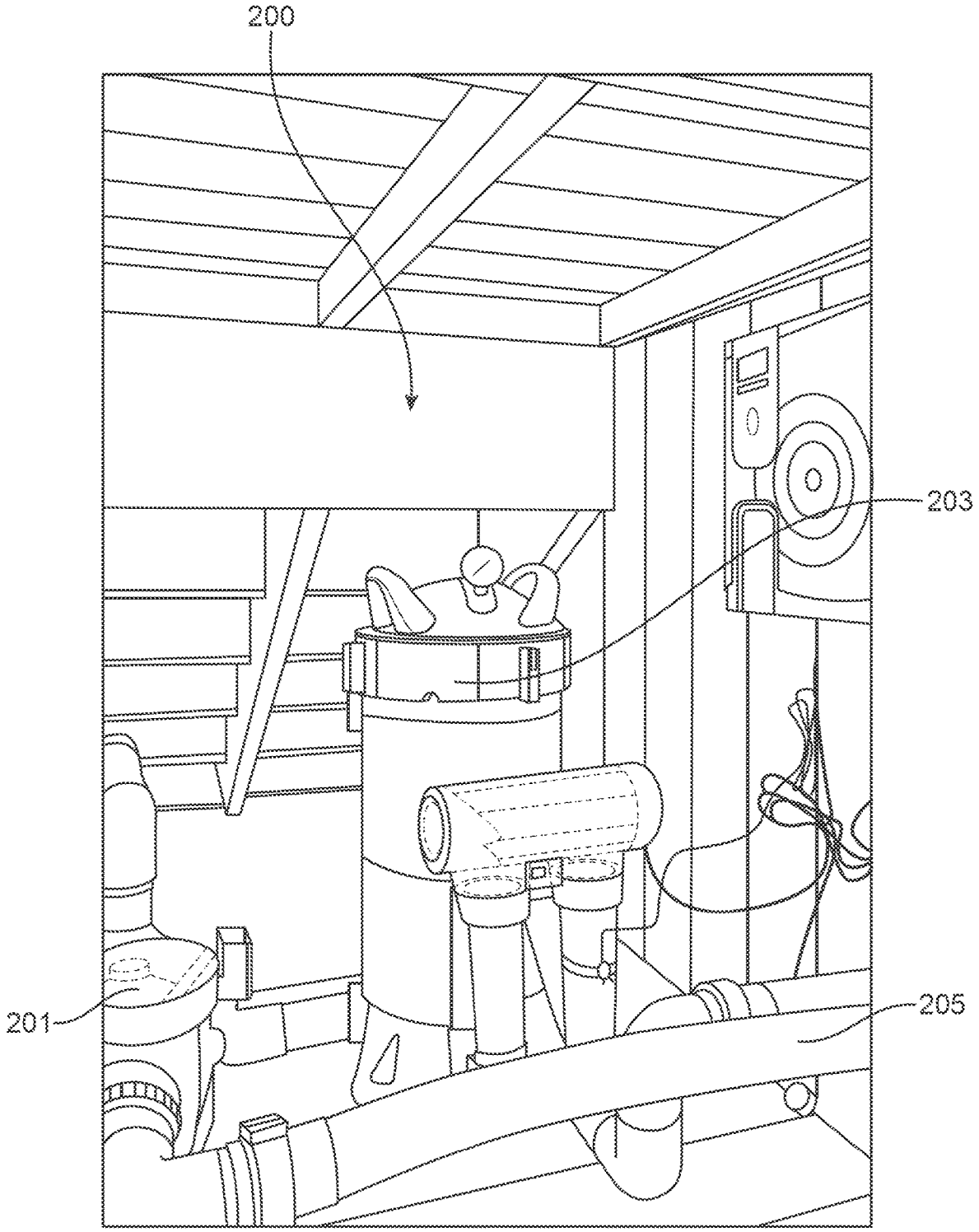
FIG. 8D depicts a filtration system accessible via a door in a cladding of a pool assembly according to aspects of the present disclosure.

In some embodiments, as illustrated in FIGS. 8A-8C, the pool assembly 100 further comprises a filtration system 200 installed prior to delivery of the pool assembly 100. The filtration system 200 may include one or more pumps 201, one or more filters 203, and additional filtration devices such as piping for fluid passageways 205 between features of the filtration system 200. In some aspects, the pump 201 may be a single speed pump. In some aspects, the filtration system 200 may be a non-aerated circulation and filtration system. The filtration system 200 may be positioned between the pool shell 102 and the cladding 106 such that the filtration system 200 is not visible. In some embodiments, as best illustrated in FIGS. 3 and 8A-C, the filtration system 200 is accessible via a door 18, or other access opening in the cladding 106. The filtration system 200 may also be positioned under stairs, a deck, or other features of the pool assembly 100. The particular location and design of the filtration system 200 may be customized by the user and/or based on the pool design of the pool assembly 100 selected by the user. Furthermore, the user may, for example, a user may customize the location of inlets and/or outlets of the filtration system 200.

According to some embodiments, the pool assembly 100 may have a selected interior surface color determined by the color of a gel coat layer on a surface of a mold during manufacture. The gel coat may be a colored resin, including, but not limited to, a thermosetting polymer (e.g., an epoxy), an unsaturated polyester, a vinylester resin chemistry, or any combination thereof. In some embodiments, the gel coat may be applied to the mold (e.g., via spraying) in a liquid state and then cured to form a crosslinked polymer. The gel coat may then be subsequently backed with thermoset polymer matrix composites (e.g., mixtures of polyester resin and fiberglass, vinylester, epoxy resin). A corrosion barrier and at least one layer of fiberglass and thermosetting polymer may then be sprayed on the gel coat to manufacture the pool shell 102. The gel coat layer may also provide the ability to customize an interior color of the pool shell. The gel coat may be less brittle than other manufacturing materials (e.g., acrylic materials) and thus may be less susceptible to cracking. Therefore, the gel coat may provide for greater flexibility in the pool shell 102 and provides for longevity of the pool shell 102 by preventing cracking of the pool shell 102 if the pool assembly 100 isn't put on a surface comprising poured cement. In addition, the gel coat may be repaired if damages are sustained (e.g., if cracks are formed in the pool shell 102).

During the next stage of manufacturing, the support structure 104 may be installed on the pool shell 102. The support members 110 may be coupled to the side wall 102*b* of the pool shell 102. The support structures 110 may provide a plurality of flat surfaces for supporting the pool assembly 100 when installed on the installation surface. Additional support structures, for example the base member 105, may also be installed on the bottom region of the pool shell 102, however, the base member 105 may also be installed later during manufacturing as will be described. The support members 110 may be fiberglassed to the side walls 102*b* of the pool shell 102 to provide structural integrity and strength to the pool shell 102 such that the pool shell 102 is structurally sound upon delivery and installation. Prior to the installation of the support structure 104, the pool shell 102 may be removed from the mold and used an inground pool.

Additional layers of the pool shell 102 may then be formed using fiberglass techniques and the pool shell 102 may be finished and removed from the mold. Upon removal from the mold, the pool shell 102 may be trimmed and positioned for additional manufacturing. With the shell 102 removed from the mold, additional support structures, for example the base member 105, may be coupled to the pool shell 102. In some embodiments, the base member 105 may be coupled to the bottom region 102*a* of the pool shell 102 using structural strength adhesive. However, any suitable fastening means may be used, including, but not limited to, screwing, welding, crimping, or any other suitable fastening means. In other embodiments, the base member 105 may also be fiberglassed to the support members 110 that were previously installed. In still yet other embodiments, the base member 105 may be fiberglassed to the pool shell 102, for example along a circumference of the pool shell. Furthermore, the base member 105 may be coupled to the pool shell 102 when the pool shell 102 is in the mold, for example, by including a base member mold shape, or any other suitable means.

The filtration system 200 may then be installed such that the pool assembly is plumbed to meet hydraulic and water recirculation standards. Thus, upon delivery, the pool assembly 100 may be ready to be filled and, upon connecting the plumbing equipment to a power source, the plumbing may be operational. A range of plumbing options may be installed during manufacturing prior to delivery of the pool assembly, including, for example, varying pump types, filtration assemblies, and/or heat systems. The desired plumbing features may be installed in various positions about the pool assembly 100 based on a client's needs, thereby adding additional customization. In some aspects, the filtration system 200 may be a non-aerated circulation and filtration system. In some aspects, the filtration system 200 may include a single speed pump The pool assembly 100 may then be framed and the cladding 106 may be installed. If a user has selected additional features such as gate 14, steps 12, and/or decking feature 16, these additional features may be added to the pool assembly 100. The coping 108 may then be installed such that the cladding 106 is positioned between the coping 108 and the support structure 104. Furthermore, the coping 108 may be fitted with openings 130 that correspond to the openings formed in the pool shell 102. The lifting bolts 120 may then be installed on the for later lifting and transportation of the pool assembly 100. The lifting bolts 120 may be installed within the opening 130. The pool assembly 100 may then be cleaned and detailed, and a quality assurance review may be completed prior to delivery.

After completing a quality assurance review, the pool assembly 100 may be transported and delivered to a user's location via a transport vehicle. Upon arriving at the desired destination, the pool assembly 100 may be lifted from the transport vehicle. The pool assembly 100 may be lifted from the transport vehicle via the lifting bolts 120. The lifting bolts 120 may be coupled to a crane (or other equipment) via the lifting device, for example ropes, that are coupled to the lifting feature 128. The pool assembly 100 may then be lifted from the transport vehicle and placed on the receiving surface 10. In some embodiments, once the pool assembly 100 has been offloaded onto the receiving surface 10, the lifting bolts 120 may be removed from the pool assembly 100 and stored for further use. For example, in cases where it is desired that the pool assembly 100 be relocated, the lifting bolts 120 may be re-coupled to the pool assembly 100 such that the pool assembly 100 may be moved again via a crane or other system.

Once the pool assembly 100 has been installed on the receiving surface 10, the pool assembly 100 may be coupled to a power source and filled with water. Thus, additional installation steps may not be required such that an additional dealer or skilled labor work is not required. Unlike aboveground pools, the pool assembly 100 does not require filtration systems 200, including plumbing features, be installed or completed during after delivery during installation. Rather, the pool assembly 100 may be assembled, including the filtration system 200 and electrical wiring, prior to delivery. Once the pool assembly 100 is delivered, the pool assembly 100 need only be filled with water and coupled to a power source. The pool assembly 100 may be shipped to a user on a flatbed, or by other transportation means, and may be lifted via a crane (or other equipment) an placed on the receiving surface 10.

A user may customize, or design, the pool assembly 100 online or in person at a dealer location. By providing various options for the pool shell 102, cladding 106, and coping 108, a user may design a personalized or customized pool assembly 100 that may be assembled prior to delivery. Thus, when the pool assembly 100 is delivered, the pool assembly 100 need only be coupled to a power source (e.g., plugged in) and filled with water. In other words, the pool structures (i.e., pool shell 102, cladding 106, and/or coping 108), the filtration system 200 (e.g., plumbing, electrical, pump system, any optional sanitation systems including automatic sanitation systems such as salt, mineral or other sanitation systems), and/or optional additional features may be fully assembled/installed prior to delivery of the pool assembly 100.

Regarding with the pool shell 102, the user may determine desired size, dimensions, shape, and/or color of the pool shell 102. Moreover, the user may further customize the pool shell 102 by including additional features, for example, steps, seats, ledges, benches, and/or jets. The user may then determine the particular materials used for the cladding 106. The user may also choose the aesthetics of the cladding 106, including, for example, the color, shade, texture, overall appearance of the cladding, thereby allowing the user to match the aesthetic of the user's location if so desired. Similarly, the user may choose to include additional features to the cladding 106 such as a door that allows access to the interior of the cladding 106, where, in some cases, the filtration system 200 may be positioned. The user may then determine the specifications for the coping 108, including, for example, the particular materials, color, texture, and dimensions. The user may further determine whether to include plug devices 132 for use with the coping 108 and, whether to form the plug devices 132 of the same or different materials as the coping 108. The user may then determine whether to include additional features such as stairs 12, gate 14, and decking feature 16. With respect to the stairs 12, the user may specify many characteristics including, for example, the number of steps, the dimensions, the materials used, and the location. Similarly, the user may choose the material, dimensions, location, and aesthetics of the gate 12 and the decking feature 16. The user may further customize the filtration system 200 used in the pool assembly 100. For example, the user may determine the type and number of pumps and filters. The user may further determine the location of the filtration system 200 within the pool assembly 100, including the location of the inlets and/or the outlets of the filtration system 200. The user may further customize the pool assembly 100 by determining any additional equipment to be included in the pool assembly 100 such as, for example, chlorinator systems, cleaners, lights, a cover and roller, airbeds, heating systems, automation systems, and/or any other suitable equipment.

As discussed above, the pool assembly 100 may vary based on the user's preferences and specifications. Turning to FIGS. 10-15, a pool assembly 220 according to aspects of the present disclosure, may include any variation of the features described above. For example, the user may specify particular materials (e.g. cladding 106 of a particular material, color of cladding 106 color), shape, size, dimensions, color, and/or combination additional features (e.g. a fence 15 or other enclosure feature, a deck feature 16 and other additional features) of the pool assembly 220 (or 100) which may be installed on various installation surfaces (e.g. lawn/grass, dirt, concrete, deck materials).

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

Example 1: A pool assembly transportable to an installation location comprising a pool shell comprising a composite material and including a gel coat layer, wherein the pool assembly includes a support structure coupled to an underside region of the pool shell, the support structure including a base plate extending laterally beyond the pool shell, the support structure further including at least one support member extending from at least one side of the pool shell, wherein the at least one support member is coupled to the base plate, a coping extending about a top region of the pool shell. The pool assembly further including a cladding material positioned externally to the pool shell and extending between the coping and the base member, and a filtration system including a filter and a pump.

Example 2: The pool assembly of Example 1, wherein the pool shell has a width greater than about 2.3 meters and a length that is greater than about 8 meters.

Example 3: The pool assembly of any of Examples 1-2, further comprising at least one lifting member coupled to the coping for lifting the pool assembly.

Example 4: The pool assembly of Example 3, wherein the at least one lifting member comprises a lifting bolt, a lifting feature coupled to the lifting bolt, and a receiving feature, wherein the lifting bolt is fastened to the receiving feature through an opening formed in the coping.

Example 5: The pool assembly of any of Examples 1-4, wherein the at least one support member comprises a substantially flat surface on a bottom end of the at least one support member such that the substantially flat surface provides support to the pool shell.

Examples 6: The pool assembly of any of Examples 1-5, wherein the pool shell comprises a reinforcement material and thermosetting polymer composite.

Example 7: The pool assembly of any of Examples 1-6, wherein the filtration system is positioned between the pool shell and the cladding.

Example 8: A method of installing a customized pool assembly including the steps of transporting the customized pool assembly in an assembled manner to an installation location, positioning the customized pool assembly on a receiving surface at the installation location, connecting the customized pool assembly to a power source. The customized pool assembly including a pool shell comprising a reinforcement material, a thermosetting polymer composite, and a gel coat layer, a support structure comprising a base member and at least two support members, a cladding material covering at least a portion of an outer surface of the pool shell, the pool assembly also including a filtration system including a filter and a pump.

Example 9: The method of Example 8, wherein the customized pool assembly further comprises at least one lifting member positioned within an opening in the pool shell.

Example 10: The method of Example 9, further comprising lifting the customized pool assembly via the at least one lifting member to position the customized pool assembly on the receiving surface.

Example 11: The method of Example 10, wherein the receiving surface is substantially flat.

Example 12: The method of Example 11, wherein receiving surface is a compressed surface with a thickness of at least 50 mm.

Example 13: A method of manufacturing a customized above ground and installation ready pool assembly comprising applying at least one layer of a composite material to a pool shell mold to form a pool shell, the composite material comprising a reinforcement material and a thermosetting polymer composite, wherein the size and shape of the pool shell mold is selected by the purchaser of the customized above ground and installation ready pool assembly, the method further including applying a gel coat to a pool shell mold, wherein the gel coat corresponds to a color selected by a purchaser of the customized above ground and installation ready pool assembly, the method also including coupling a plurality of support members to the pool shell, each support member of the plurality of support members extending outwardly from a side wall of the pool shell, and installing a filtration system including a filter and a pump, also coupling a cladding material the pool shell, wherein the color of the cladding material is selected by the purchaser of the customized above ground and installation ready pool assembly.

Example 14: The method of Example 13, wherein the gel coat is applied to the pool shell mold in a liquid state, wherein the gel coat is cured to form a crosslinked polymer.

Example 15: The method of any of Examples 13-14 further comprising coupling a base member to: (i) each support member of the plurality of support members, and (ii) a bottom region of the pool shell.

Example 16: The method of any of Examples 13-15, further comprising applying a corrosion barrier to the pool shell, wherein the corrosion barrier comprises at least one layer of fiberglass and thermosetting polymer, and wherein the corrosion barrier is sprayed on the gel coat.

Example 17: The method of any of Examples 13-16, wherein the support members are fiberglassed to the side wall of the pool shell.

Example 18: The method of Example 15, wherein the base member is fiberglassed to the plurality of support member.

Example 19: The method of Example 18, further comprising applying a coping to the pool shell such that the cladding material extends between the coping and the base member.

Example 20: The method of Example 19, further comprising installing a lifting member within an opening formed in the pool shell for lifting the customized above ground and installation ready pool assembly.

What is claimed is:

1. A pool assembly transportable to an installation location comprising:

a pool shell comprising a composite material and including a gel coat layer;

a support structure coupled to an underside region of the pool shell, the support structure including a base plate extending laterally beyond the pool shell, the support structure further including at least one support member extending from at least one side of the pool shell, wherein the at least one support member is coupled to the base plate;

a coping extending about a top region of the pool shell;

a cladding material positioned externally to the pool shell and the support structure;

a filtration system including a filter and a pump, wherein the filtration system is at least partially arranged between the pool shell and the cladding material;

an opening formed in the coping; and a lifting member for lifting the pool assembly and configured to be removably positioned within the opening, wherein the opening is configured to be covered using a plug.

2. The pool assembly of claim 1, wherein the pool shell has a width greater than about 2.3 meters and a length that is greater than about 8 meters.

3. The pool assembly of claim 1, wherein the at least one lifting member comprises:

a lifting bolt, a lifting feature coupled to the lifting bolt, and a receiving feature, wherein the lifting bolt is fastened to the receiving feature through the opening formed in the coping.

4. The pool assembly of claim 1, wherein the at least one support member comprises a substantially flat surface on a bottom end of the at least one support member such that the substantially flat surface provides support to the pool shell.

5. The pool assembly of claim 1, wherein the pool shell comprises a reinforcement material and thermosetting polymer composite.

6. The pool assembly of claim 1, wherein the filtration system is positioned between the pool shell and the cladding material.

7. A method of installing a customized pool assembly comprising:

transporting the customized pool assembly in an assembled manner to an installation location;

positioning the customized pool assembly on a receiving surface at the installation location;

connecting the customized pool assembly to a power source;

wherein the customized pool assembly comprises:

a pool shell comprising a reinforcement material, a thermosetting polymer composite, and a gel coat layer;

a support structure comprising a base member and at least two support members;

a cladding material covering at least a portion of an outer surface of the pool shell and at least a portion of an outer surface of the support structure; and a filtration system including a filter and a pump, wherein the filtration system is at least partially arranged between the pool shell and the cladding material;

an opening formed in the pool shell; and a lifting member for lifting the pool assembly and configured to be removably positioned within the opening, wherein the opening is configured to be covered using a plug.

8. The method of claim 7, further comprising lifting the customized pool assembly via the at least one lifting member to position the customized pool assembly on the receiving surface.

9. The method of claim 8, wherein the receiving surface is substantially flat.

10. The method of claim 9, wherein receiving surface is a compressed surface with a thickness of at least 50 mm.

11. A method of manufacturing a customized above ground and installation ready pool assembly comprising:

applying at least one layer of a composite material to a pool shell mold to form a pool shell, the composite material comprising a reinforcement material and a thermosetting polymer composite, wherein a size and a shape of the pool shell mold is selected by a purchaser of the customized above ground and installation ready pool assembly;

applying a gel coat to the pool shell mold, wherein the gel coat corresponds to a color selected by the purchaser of the customized above ground and installation ready pool assembly;

coupling a plurality of support members to the pool shell, each support member of the plurality of support members extending outwardly from a side wall of the pool shell;

coupling a base member that extends laterally beyond the pool shell to: (i) each support member of the plurality of support members, and (ii) a bottom region of the pool shell installing a filtration system including a filter and a pump;

coupling a cladding material the pool shell, wherein the cladding material is positioned externally to the pool shell and the plurality of support members, the filtration system is at least partially arranged between the pool shell and the cladding material, and the color of the cladding material is selected by the purchaser of the customized above ground and installation ready pool assembly; and applying a coping to a top region of the pool shell such that the cladding material extends between the coping and the base member;

wherein the pool assembly further comprises:

an opening formed in the pool shell; and a lifting member for lifting the pool assembly and configured to be removably positioned within the opening, wherein the opening is configured to be covered using a plug.

12. The method of claim 11, wherein the gel coat is applied to the pool shell mold in a liquid state, wherein the gel coat is cured to form a crosslinked polymer.

13. The method of claim 12, further comprising applying a corrosion barrier to the pool shell, wherein the corrosion barrier comprises at least one layer of fiberglass and thermosetting polymer, and wherein the corrosion barrier is sprayed on the gel coat.

14. The method of claim 12, wherein the plurality of support members are fiberglassed to the side wall of the pool shell.

15. The method of claim 14, wherein the base member is fiberglassed to the plurality of support members.

16. The method of claim 15, further comprising installing the lifting member within the opening formed in the pool shell for lifting the customized above ground and installation ready pool assembly.

17. The pool assembly of claim 1, wherein the filtration system is arranged between the pool shell and the cladding material.

18. The pool assembly of claim 17, wherein the cladding material comprises at least one door arranged to provide access to the filtration system.

19. The pool assembly of claim 3, wherein the receiving feature is positioned at least partially on a first side of the coping, the lifting feature is positioned at least partially on a second side of the coping, and the first side is opposite the second side.

20. The method of claim 7, wherein the at least one lifting member comprises:

a lifting bolt;

a lifting feature coupled to the lifting bolt; and a receiving feature, wherein the lifting bolt is fastened to the receiving feature through the opening formed in the pool shell;

wherein the receiving feature is positioned at least partially on a first side of the pool shell, the lifting feature is positioned at least partially on a second side of the pool shell, and the first side is opposite the second side.

* * * * *